US008702824B1

(12) United States Patent
Sani et al.

(10) Patent No.: US 8,702,824 B1
(45) Date of Patent: Apr. 22, 2014

(54) POLYCRYSTALLINE DIAMOND COMPACT INCLUDING A POLYCRYSTALLINE DIAMOND TABLE FABRICATED WITH ONE OR MORE $SP^2$-CARBON-CONTAINING ADDITIVES TO ENHANCE CUTTING LIP FORMATION, AND RELATED METHODS AND APPLICATIONS

(75) Inventors: Mohammad N. Sani, Orem, UT (US); Jair J. Gonzalez, Provo, UT (US); Andrew E. Dadson, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 593 days.

(21) Appl. No.: 12/875,380

(22) Filed: Sep. 3, 2010

(51) Int. Cl.
*B24D 11/00* (2006.01)

(52) U.S. Cl.
USPC ..... 51/297; 51/307; 423/446

(58) Field of Classification Search
None
See application file for complete search history.

(56) References Cited

U.S. PATENT DOCUMENTS

| | | | | |
|---|---|---|---|---|
| 4,268,276 | A | 5/1981 | Bovenkerk | |
| 4,410,054 | A | 10/1983 | Nagel et al. | |
| 4,468,138 | A | 8/1984 | Nagel | |
| 4,560,014 | A | 12/1985 | Geczy | |
| RE32,380 | E * | 3/1987 | Wentorf et al. | 407/119 |
| 4,738,322 | A | 4/1988 | Hall et al. | |
| 4,811,801 | A | 3/1989 | Salesky et al. | |
| 4,913,247 | A | 4/1990 | Jones | |
| 5,016,718 | A | 5/1991 | Tandberg | |
| 5,045,092 | A * | 9/1991 | Keshavan | 51/293 |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,158,148 | A * | 10/1992 | Keshavan | 175/426 |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 6,009,963 | A | 1/2000 | Chaves et al. | |
| 6,216,805 | B1 | 4/2001 | Lays et al. | |
| 6,601,662 | B2 | 8/2003 | Matthias et al. | |
| 6,793,681 | B1 | 9/2004 | Pope et al. | |
| 7,493,965 | B1 * | 2/2009 | Bertagnolli et al. | 175/17 |
| 7,516,804 | B2 * | 4/2009 | Vail | 175/434 |

(Continued)

OTHER PUBLICATIONS

U.S. Appl. No. 12/845,339, filed Jul. 28, 2010, Sani, et al.

(Continued)

*Primary Examiner* — Kaj K Olsen
*Assistant Examiner* — Ross J Christie
(74) *Attorney, Agent, or Firm* — Dorsey & Whitney LLP

(57) ABSTRACT

In an embodiment, a polycrystalline diamond compact ("PDC") includes a substrate and a polycrystalline diamond ("PCD") table bonded to the substrate. The PCD table includes a first PCD region having bonded-together diamond grains, with the first PCD region exhibiting a first thermal stability and a first diamond density. The PCD table further includes an intermediate second PCD region bonded to the substrate and disposed between the first PCD region and the substrate. The intermediate second PCD region includes bonded-together diamond grains. The intermediate second PCD region exhibits a second thermal stability that is less than that of the first thermal stability of the first PCD region and a second diamond density less than that of the first diamond density of the first PCD region.

13 Claims, 10 Drawing Sheets

(56) References Cited

U.S. PATENT DOCUMENTS

| | | | | |
|---|---|---|---|---|
| 7,635,035 | B1 * | 12/2009 | Bertagnolli et al. | 51/307 |
| 2005/0257430 | A1 * | 11/2005 | Fries et al. | 51/307 |
| 2006/0272571 | A1 * | 12/2006 | Cho | 117/84 |
| 2007/0046120 | A1 * | 3/2007 | Cooley et al. | 310/90.5 |
| 2007/0187153 | A1 * | 8/2007 | Bertagnolli | 175/374 |
| 2008/0023231 | A1 * | 1/2008 | Vail | 175/434 |
| 2008/0142267 | A1 | 6/2008 | Griffin et al. | |
| 2008/0179109 | A1 | 7/2008 | Belnap et al. | |
| 2008/0302579 | A1 * | 12/2008 | Keshavan et al. | 175/434 |
| 2009/0158670 | A1 * | 6/2009 | Vail | 51/307 |
| 2010/0104874 | A1 | 4/2010 | Yong et al. | |
| 2010/0192473 | A1 | 8/2010 | Keshavan | |
| 2010/0294571 | A1 * | 11/2010 | Belnap et al. | 51/307 |
| 2011/0031034 | A1 * | 2/2011 | DiGiovanni et al. | 175/428 |
| 2011/0056141 | A1 * | 3/2011 | Miess et al. | 51/295 |
| 2011/0073380 | A1 * | 3/2011 | DiGiovanni | 51/307 |
| 2011/0132666 | A1 | 6/2011 | DiGiovanni et al. | |
| 2011/0262295 | A1 * | 10/2011 | Voronov et al. | 419/11 |
| 2011/0271603 | A1 | 11/2011 | Voronin et al. | |

OTHER PUBLICATIONS

U.S. Appl. No. 12/845,339, Sep. 28, 2012, Office Action.

U.S. Appl. No. 12/845,339, Mar. 13, 2013, Office Action.

U.S. Appl. No. 12/845,339, May 24, 2013, Advisory Action.

* cited by examiner

POLYCRYSTALLINE DIAMOND COMPACT INCLUDING A POLYCRYSTALLINE DIAMOND TABLE FABRICATED WITH ONE OR MORE $SP^2$-CARBON-CONTAINING ADDITIVES TO ENHANCE CUTTING LIP FORMATION, AND RELATED METHODS AND APPLICATIONS

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate (e.g. a cemented carbide) using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing A rotary drill bit typically includes a number of PDC cutting elements connected to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a substrate into a container with a volume of diamond particles positioned on a surface of the substrate. A number of such containers may be loaded into an HPHT press. The substrate (s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented-carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

Despite the availability of a number of different PDCs, manufacturers and users of PDCs continue to seek PDCs that exhibit improved toughness, wear resistance, thermal stability, or combinations of the foregoing.

SUMMARY

Embodiments of the invention relate to PDCs including a PCD table having a PCD region fabricated with one or more precursor $sp^2$-carbon-containing additives that enhances at least one performance characteristic (e.g., thermal stability, wear resistance, diamond density, or combinations thereof) in order to promote lip formation, drill bits using such PDCs, and methods of manufacture. For example, the one or more $sp^2$-carbon-containing additives may include a $sp^2$-carbon-containing material, such as graphite, graphene, fullerenes, ultra-dispersed diamond particles, or combinations of the foregoing that enhance diamond density of sintered PCD, thermal stability of sintered PCD, wear resistance of sintered PCD, or combinations of the foregoing.

In an embodiment, a PDC includes a substrate and a PCD table bonded to the substrate. The PCD table includes a first PCD region having bonded-together diamond grains, with the first PCD region exhibiting a first thermal stability and a first diamond density. The PCD table further includes an intermediate second PCD region bonded to the substrate and disposed between the first PCD region and the substrate. The intermediate second PCD region includes bonded-together diamond grains. The intermediate second PCD region exhibits a second thermal stability that is less than that of the first thermal stability of the first PCD region and a second diamond density less than that of the first diamond density of the first PCD region.

In an embodiment, a method of fabricating a PDC includes forming an assembly having a first region including a mixture having diamond particles and one or more $sp^2$-carbon-containing additives, a substrate, and an intermediate second region disposed between the substrate and the first region. The intermediate second region also includes diamond particles. The method further includes subjecting the assembly to an HPHT process to sinter the diamond particles of the first region and the intermediate second region in the presence of a metal-solvent catalyst so that a PCD table is formed that bonds to the substrate.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to PDCs including a PCD table having a PCD region fabricated with a precursor one or more $sp^2$-carbon-containing additives that enhances at least one performance characteristic (e.g., thermal stability, wear resistance, or combinations thereof) in order to promote lip formation, drill bits using such PDCs, and methods of manufacture. For example, the one or more $sp^2$-carbon-containing additives may include an $sp^2$-carbon-containing material, such as graphite, graphene, fullerenes, ultra-dispersed diamond particles, or combinations of the foregoing that enhance a diamond density of sintered PCD, a thermal stability of sintered PCD, a wear resistance of sintered PCD, or combinations of the foregoing. The disclosed PDCs may also be used in a variety of other applications, such as machining equipment, bearing apparatuses, and other articles and apparatuses.

Figure 1A:
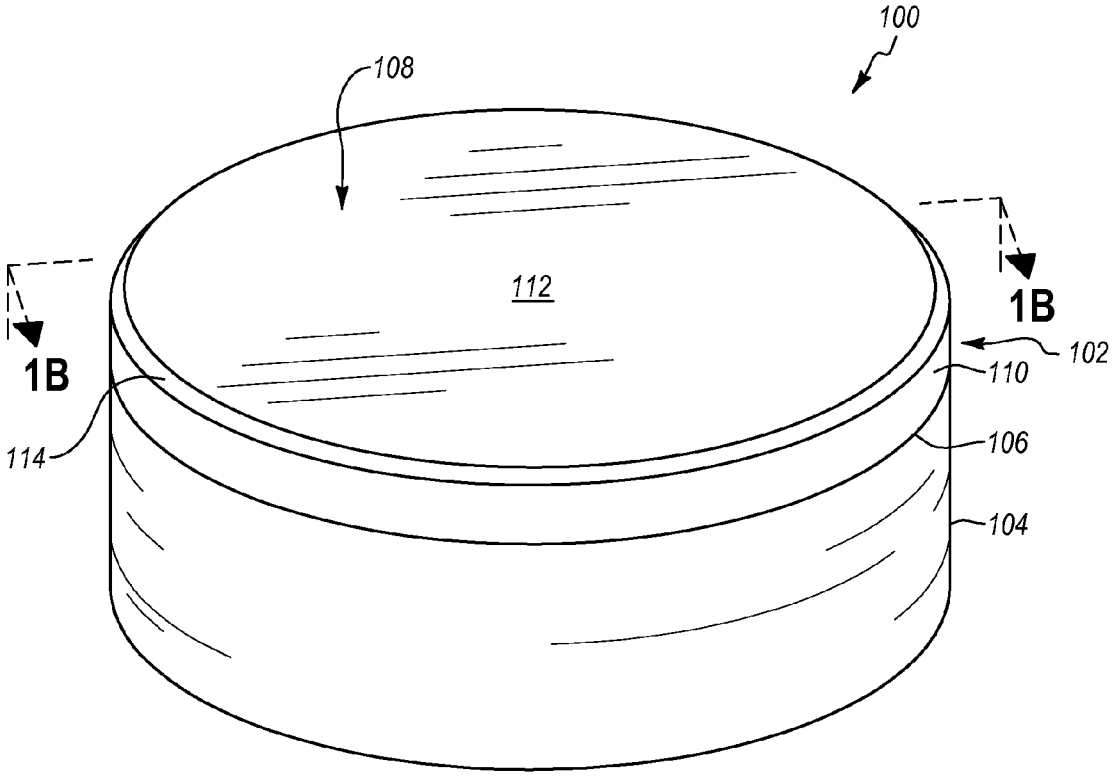
FIG. 1A is an isometric view of an embodiment of a PDC including a PCD table having a PCD region with at least one of an enhanced thermal stability, an enhanced diamond density, or an enhanced wear resistance that promotes forming a cutting lip during drilling operations.
Figure 1B:
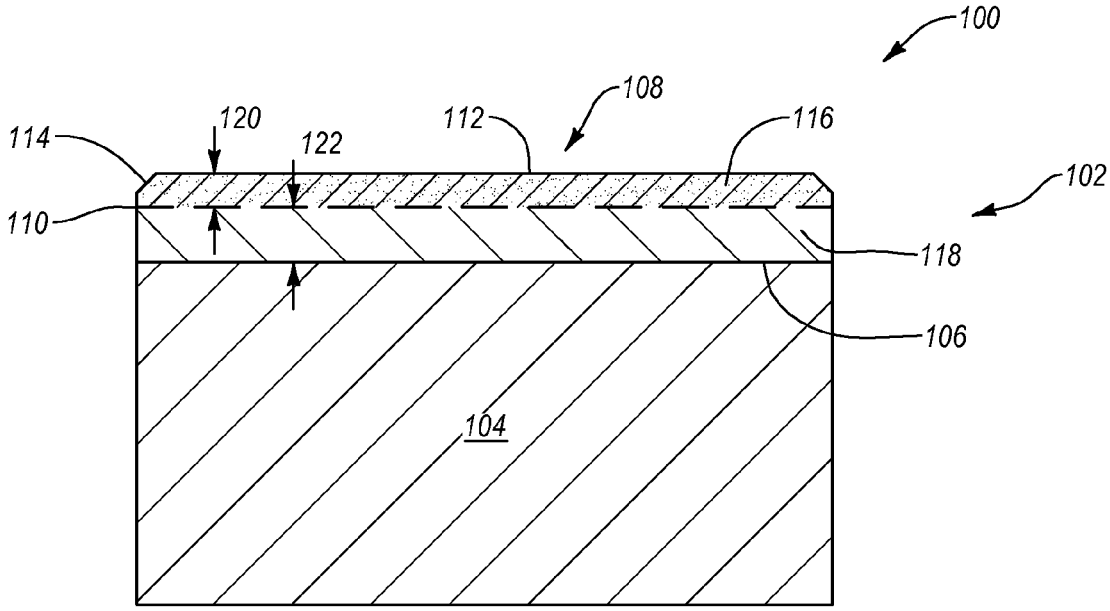
FIG. 1B is a cross-sectional view of the PDC shown in FIG. 1A taken along line 1B-1B.

FIGS. 1A and 1B are isometric and cross-sectional views, respectively, of an embodiment of a PDC 100. The PDC 100 includes a PCD table 102 and a substrate 104 having an interfacial surface 106 that is bonded to the PCD table 102. For example, the substrate 104 may comprise a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys of the foregoing metals. In an embodiment, the cemented carbide substrate may comprise a cobalt-cemented tungsten carbide substrate. Although the interfacial surface 106 is illustrated as being substantially planar, the interfacial surface 106 may exhibit a selected nonplanar topography.

The PCD table 102 includes a plurality of directly bonded-together diamond grains exhibiting diamond-to-diamond bonding (e.g., $sp^3$ bonding) therebetween. As will be discussed in more detail below, the PCD table 102 may be formed on the substrate 104 (i.e., integrally formed with the substrate 104) by HPHT sintering diamond particles on the substrate 104. The plurality of directly bonded-together diamond grains define a plurality of interstitial regions. The PCD table 102 defines an upper surface 108 and peripheral surface 110. In the illustrated embodiment, the upper surface 108 includes a substantially planar major surface 112 and a peripherally-extending chamfer 114 that extends between the peripheral surface 110 and the major surface 112. It should be noted that the upper surface 108 and/or the peripheral surface 110 may function as a working surface that contacts a formation during drilling.

Referring specifically to FIG. 1B, the PCD table 102 includes a thermally-stable first PCD region 116 remote from the substrate 104 that includes the major surface 112, the chamfer 114, and may include a portion of the peripheral surface 110. The first PCD region 116 extends inwardly to a selected depth from the major surface 112. The PCD table 102 also includes an intermediate second PCD region 118 adjacent to and bonded to the interfacial surface 106 of the substrate 104. Metal-solvent catalyst infiltrated from the substrate 104 during HPHT processing occupies the interstitial regions of the first and second PCD regions 116 and 118 of the PCD table 102. For example, the metal-solvent catalyst may be cobalt from a cobalt-cemented tungsten carbide substrate that infiltrated into the second PCD region 118.

The first PCD region 116 has been fabricated in the presence of one or more $sp^2$-carbon-containing additives (e.g., graphite, graphene, fullerenes, ultra-dispersed diamond particles, or combinations of the foregoing) to impart a thermal stability of the first PCD region 116, a wear resistance of the first PCD region 116, a diamond density of the first PCD region 116, or combinations of the foregoing that is enhanced relative to the underlying second PCD region 118. By forming the first PCD region 116 to exhibit at least one of a greater thermal stability, wear resistance, or diamond density (e.g., amount of diamond-to-diamond bonding) than the underlying second PCD region 118, a beneficial cutting lip is formed during cutting a formation. For example, a diamond density of the first PCD region 116 may be about 1% to about 10% greater than a diamond density of the second PCD region 118, such as about 1% to about 5% or about 5% to about 10%. The enhanced performance of the first PCD region 116 may be manifested by a distinct cutting lip that forms during cutting a formation defined by a worn edge of the first PCD region 116.

In some embodiments, the second PCD region 118 may further include an additive selected to lower a thermal stability and/or a wear resistance of the second PCD region 118 relative to the first PCD region 116 to further promote cutting lip formation. For example, the additive may be chosen from one or more metal carbides, such as carbides of tungsten, chromium, niobium, tantalum, or combinations thereof. The additive may be present in the second PCD region 118 in an amount of about 1 weight percent ("wt %") to about 15 wt %, such as 3 wt % to about 12 wt %, about 4.5 to about 6.5, about 4.5 wt % to about 5.5 wt, or about 5 wt %.

To promote formation of a sharp cutting lip during cutting operations, a thickness 120 of the first PCD region 116 may be about 5 to about 25 times less than a thickness 122 of the underlying second PCD region 118, such as about 10 to about 25 times less than the thickness 122, about 15 to about 25 times less than the thickness 122, about 1 to about 10 times less than the thickness 122, or about 15 to about 20 times less than the thickness 122. For example, the thickness 120 may be about 100 μm to about 1000 μm, such as about 100 μm to about 500 μm or about 150 μm to about 300 μm.

Figure 2:
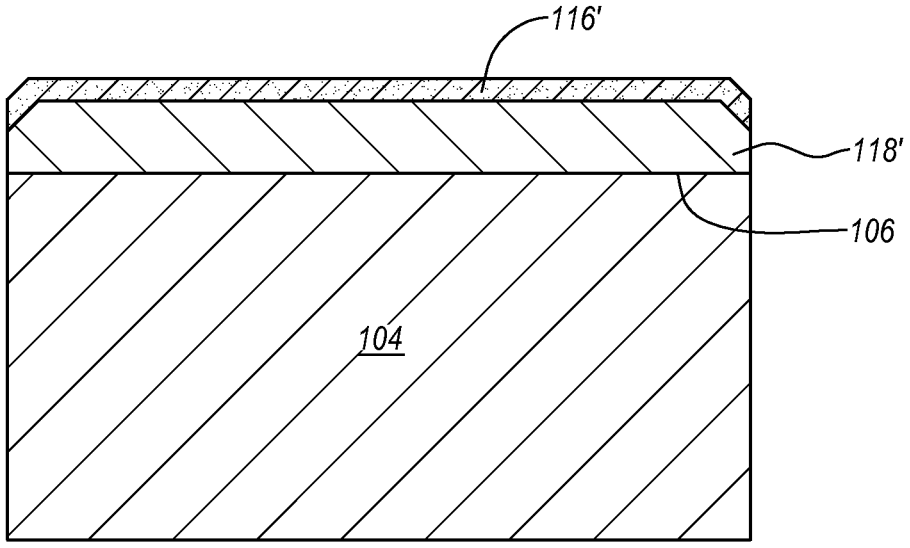
FIG. 2 is a cross-sectional view of a PDC according to another embodiment.

Referring to the cross-sectional view in FIG. 2, in another embodiment, the first PCD region 116' (which may be similarly configured as described above with respect to the first PCD region 116) may contour the underlying second PCD region 118' (which may be similarly configured as described above with respect to the second PCD region 118). In such an embodiment, the thickness of the first PCD region 116' may be made relatively thinner than that of the first PCD region 116 shown in FIG. 1B while still providing a sufficient large coverage of the working region.

Figure 3:
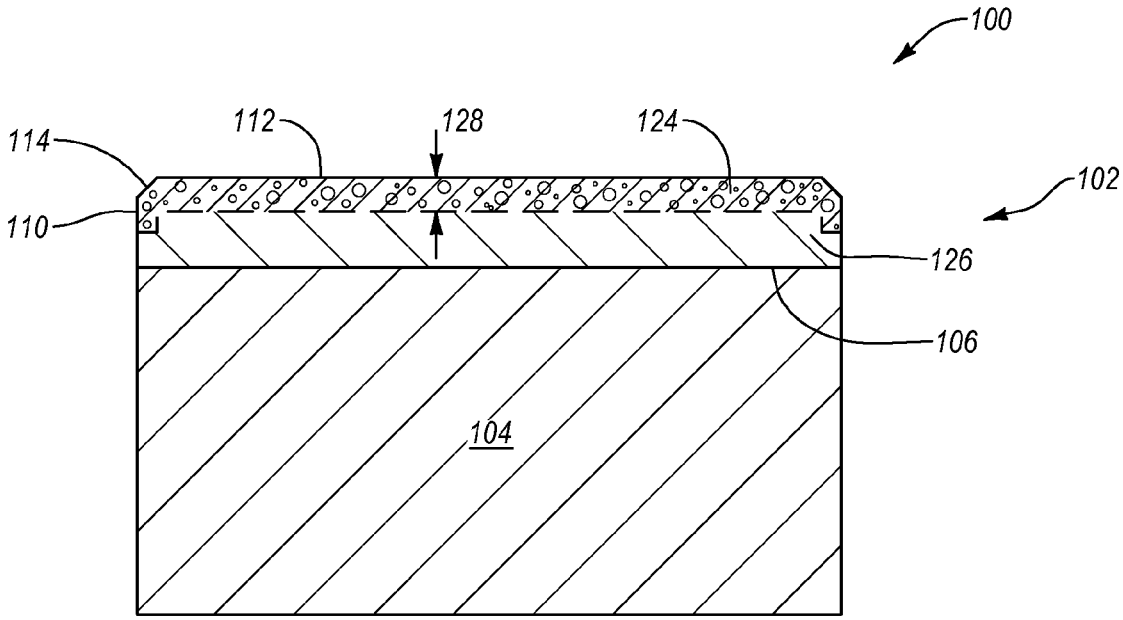
FIG. 3 is a cross-sectional view of the PDC shown in FIG. 1A after leaching metal-solvent catalyst from a portion of the PCD table in accordance with another embodiment.

FIG. 3 is a cross-sectional view of the PDC 100 shown in FIGS. 1A and 1B after leaching metal-solvent catalyst from the first PCD region 116 of the PCD table 102 to further improve thermal stability of the PCD table 102 in accordance with another embodiment. The first PCD region 116 shown in FIG. 1B has been leached to deplete the metal-solvent catalyst therefrom that used to occupy the interstitial regions between the bonded diamond grains of the first PCD region 116 to form a leached region 124, with the unaffected underlying PCD region labeled as region 126. The leaching may be performed in a suitable acid (e.g., aqua regia, nitric acid, hydrofluoric acid, or combinations thereof) or by a suitable other method so that the leached region 124 is substantially free of the metal-solvent catalyst. As a result of the metal-solvent catalyst being depleted from the leached region 124, the leached region 124 is even more relatively thermally stable than the underlying unaffected PCD region 126. Generally, a maximum leach depth 128 may be about 50 μm to about 900 μm. For example, the maximum leach depth 128 for the leached second region 122 may be about 300 μm to about 425 μm, about 350 μm to about 400 μm, about 350 μm to about 375 μm, about 375 μm to about 400 μm, or about 500 μm to about 650 μm. In some embodiments, the maximum leach depth may be no greater than the depth 128 of the first PCD region 116 because the first PCD region 116 may be relatively more difficult than the underlying second PCD region 118 to remove the metal-solvent catalyst therefrom due at least, in part, to the increased diamond density in the first PCD region 116. However, in other embodiments, the leached region 124 may extend past the first PCD region 116 and into the second PCD region 118. The maximum leach depth 128 may be measured inwardly from at least one of the major surface 112, the chamfer 114, or the peripheral surface 110. In some embodiments, the leach depth measured inwardly from the chamfer 114 and/or the peripheral surface 110 may be about 5% to about 30% less than the leach depth measured from major surface 112.

Figure 4A:
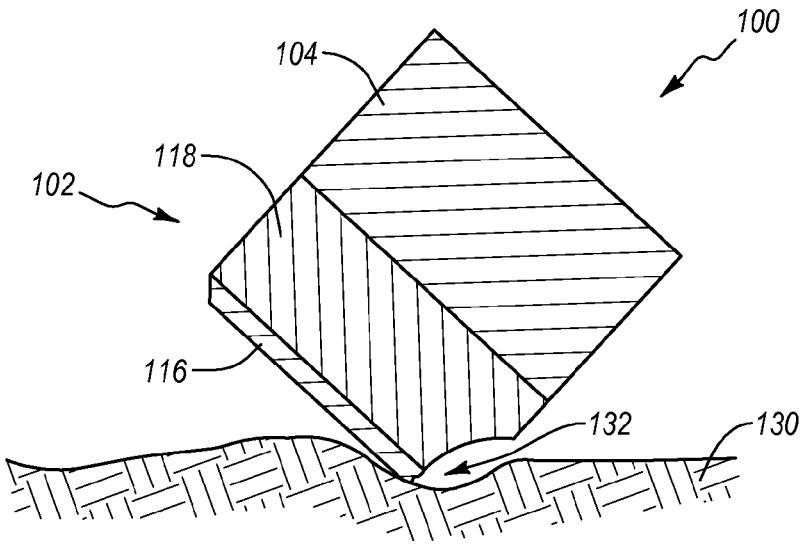
FIG. 4A is a cross-sectional view of the PDC of FIG. 1A illustrating cutting lip formation in the PCD table during cutting a formation.
Figure 4B:
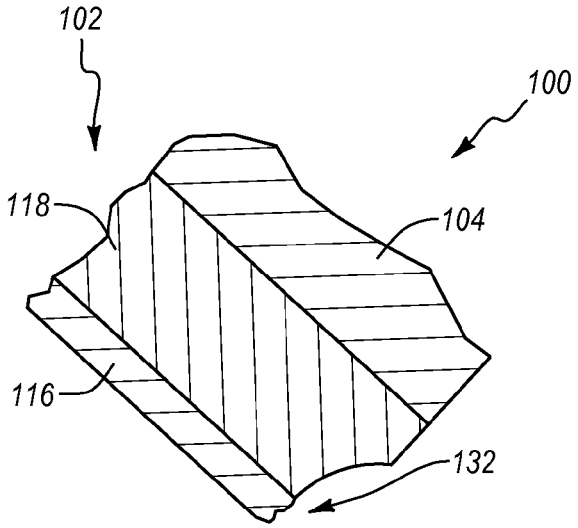
FIG. 4B is an enlarged cross-sectional view of the PDC shown in FIG. 4A.

FIGS. 4A and 4B are cross-sectional views of the PDC 100 of FIG. 1A illustrating cutting lip formation in the PCD table 102 during cutting a formation. During cutting a formation 130 (e.g., a subterranean formation), the less thermally stable and less wear resistant second PCD region 118 may preferentially wear away more rapidly than the more thermally stable and wear resistant first PCD region 116 to form a cutting lip 132. The cutting lip 132 may enhance penetration into the formation 130 and, thus, the ability to drill into the subterranean formation 130. If the entire PCD table 102 were made from the first PCD region 116 (i.e., fabricated from a mixture of diamond particles and one or more $sp^2$-carbon-containing additives, such as graphite), a pronounced wear flat would form without a well-defined cutting lip.

Figure 5A:
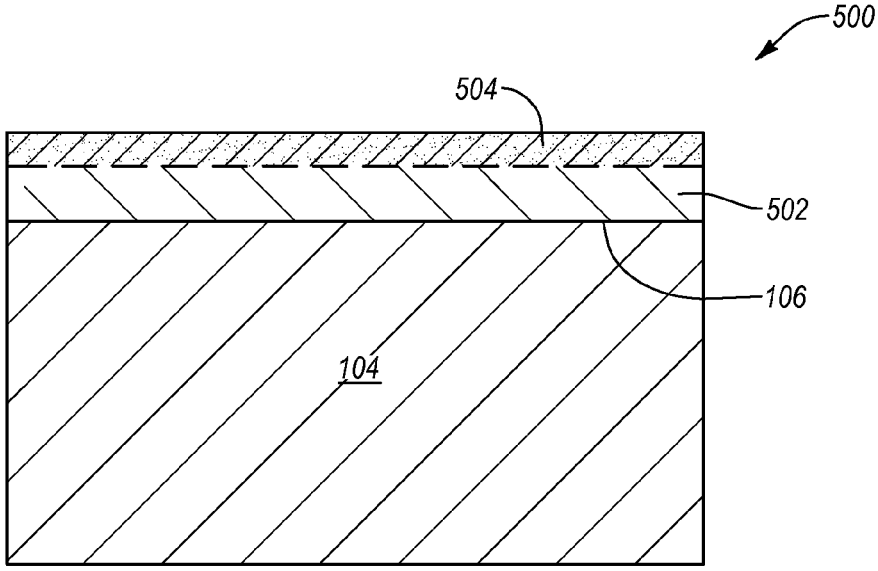
FIGS. 5A-5C are cross-sectional views at various stages during the manufacture of the PDC shown in FIGS. 1A and 1B according to an embodiment.
Figure 5B:
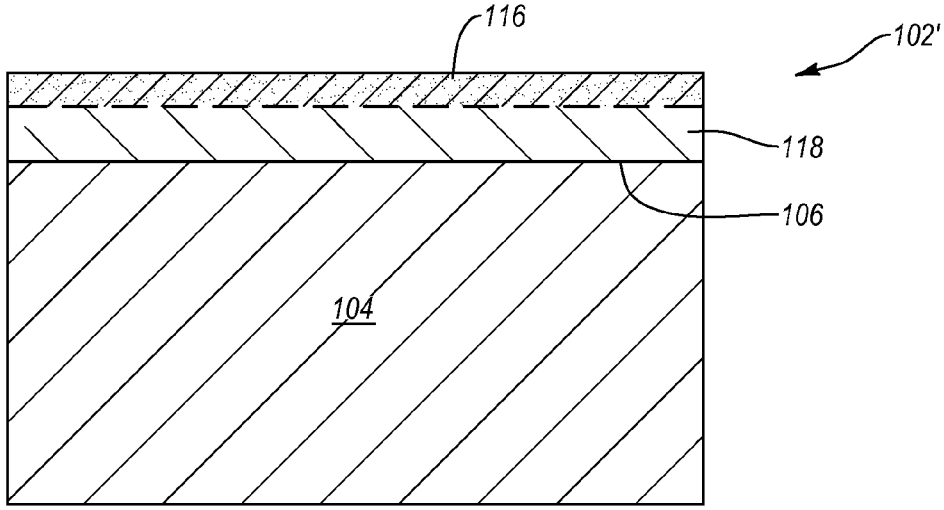
Figure 5C:
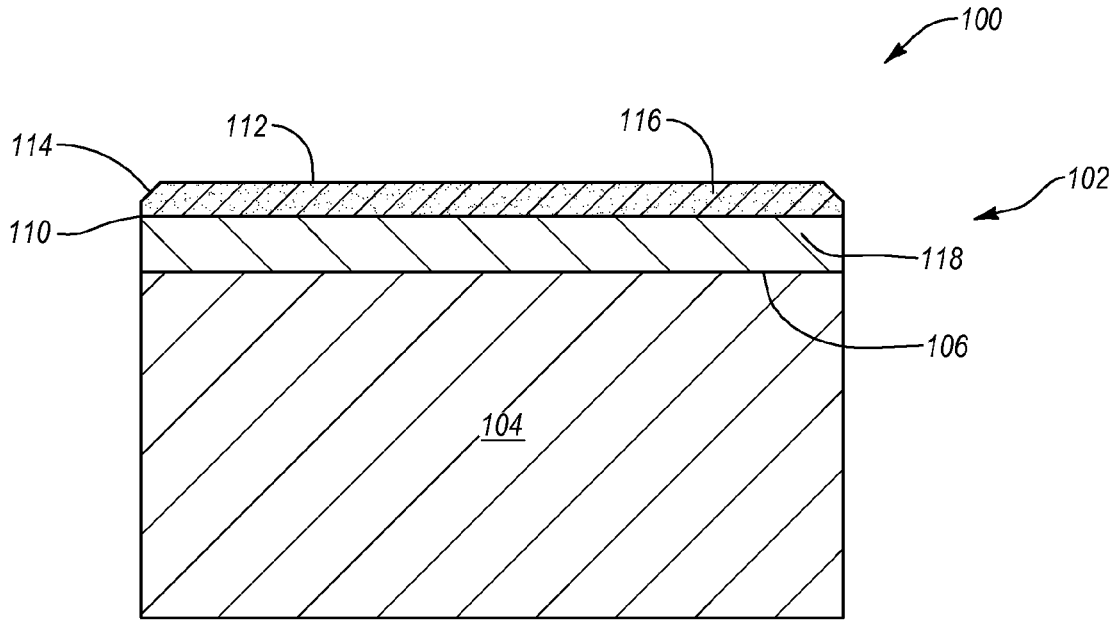

FIGS. 5A-5C are cross-sectional views at various stages during the manufacture of the PDC 100 shown in FIGS. 1A and 1B according to an embodiment. Referring to FIG. 5A, an assembly 500 may be formed by disposing one or more layers 502 including diamond particles adjacent to the interfacial surface 106 of the substrate 104 and adjacent to one or more layers 504 including a mixture of diamond particles and one or more $sp^2$-carbon-containing additives. After HPHT processing of the assembly 500, the one or more layers 502 ultimately form part of the second PCD region 118 shown in FIG. 1B and the one or more layers 504 form part of the first PCD region 116.

In some embodiments, the one or more layers 502 may further include an additive selected to lower a thermal stability and/or a wear resistance of the second PCD region 118 relative to the first PCD region 116. For example, the additive may be chosen from one or more metal carbides, such as carbides of tungsten, chromium, niobium, tantalum, or combinations thereof. The additive may be present in the one or more layers 502 in an amount of about 1 weight percent ("wt %") to about 15 wt %, such as 3 wt % to about 12 wt %, about 4.5 to about 6.5, about 4.5 wt % to about 5.5 wt, or about 5 wt %.

The plurality of diamond particles of the one or more layers 502, 504 may each exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes), without limitation.

In some embodiments, an average diamond particle size of the one or more layers 504 may be less than an average diamond particle size of the one or more layers 502. In such an embodiment, the first PCD region 116 may exhibit an average diamond grain size that is less than an average diamond grain size of the second PCD region 118. In other embodiments, an average diamond particle size of the one or more layers 504 may be greater than an average diamond particle size of the one or more layers 502. In such an embodiment, the first PCD region 116 may exhibit an average diamond grain size that is greater than an average diamond grain size of the second PCD region 118.

The one or more $sp^2$-carbon-containing additives may be selected from graphite particles, graphene particles, fullerene particles, ultra-dispersed diamond particles, or combinations of the foregoing. All of the foregoing $sp^2$-carbon-containing additives at least partially include $sp^2$ hybridization. For example, graphite, graphene (i.e., a one-atom-thick planar sheet of $sp^2$-bonded carbon atoms that form a densely-packed honeycomb lattice), and fullerenes contain $sp^2$ hybridization for the carbon-to-carbon bonds, while ultra-dispersed diamond particles contain a PCD core with $sp^3$ hybridization and an $sp^2$-carbon shell. The non-diamond carbon present in the one or more $sp^2$-carbon-containing additives substantially converts to diamond during the HPHT fabrication process discussed in more detail below. The presence of the $sp^2$-carbon-containing material during the fabrication of the PCD table 102 is believed to enhance at least one of the diamond density, thermal stability, or wear resistance of the first PCD region 116 of the PCD table 102 relative to the second PCD region 118. For any of the disclosed one or more $sp^2$-carbon-containing additives, the one or more $sp^2$-carbon-containing additives may be selected to be present in a mixture of the one or more layers 504 with the plurality of diamond particles in an amount of greater than 0 wt % to about 20 wt %, such as about 1 wt % to about 15 wt %, about 2 wt % to about 10 wt %, about 3 wt % to about 6 wt %, about 3 wt % to about 8 wt %, about 4.5 wt % to about 5.5 wt %, or about 5 wt %.

The graphite particles employed for the one or more $sp^2$-carbon-containing additives may exhibit an average particle size of about 1 μm to about 20 μm (e.g., about 1 μm to about 15 μm or about 1 μm to about 3 μm). In some embodiments, the graphite particles may be sized fit into interstitial regions defined by the plurality of diamond particles. However, in other embodiments, graphite particles that do not fit into the interstitial regions defined by the plurality of diamond particles may be used because the graphite particles and the diamond particles may be crushed together so that the graphite particles fit into the interstitial regions. According to various embodiments, the graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa.

An ultra-dispersed diamond particle (also commonly known as a nanocrystalline diamond particle) is a particle generally composed of a PCD core surrounded by a metastable carbon shell. Such ultra-dispersed diamond particles may exhibit a particle size of about 1 nm to about 50 nm and, more typically, of about 2 nm to about 20 nm. Agglomerates of ultra-dispersed diamond particles may be between about 2 nm to about 200 nm. Ultra-dispersed diamond particles may be formed by detonating trinitrotoluene explosives in a chamber and subsequent purification to extract diamond particles or agglomerates of diamond particles with the diamond particles generally composed of a PCD core surrounded by a metastable shell that includes amorphous carbon and/or carbon onion (i.e., closed shell $sp^2$ nanocarbons). Ultra-dispersed diamond particles are commercially available from ALIT Inc. of Kiev, Ukraine. The metastable shells of the ultra-dispersed diamond particles may serve as a non-diamond carbon source.

One common form of fullerenes includes 60 carbon atoms arranged in a geodesic dome structure. Such a carbon structure is termed a "Buckminsterfullerene" or "fullerene," although such structures are also sometimes referred to as "buckyballs." Fullerenes are commonly denoted as $C_n$ fullerenes (e.g., n=24, 28, 32, 36, 50, 60, 70, 76, 84, 90, or 94) with "n" corresponding to the number of carbon atoms in the "complete" fullerene structure. Furthermore, elongated fullerene structures may contain millions of carbon atoms, forming a hollow tube-like structure just a few atoms in circumference. These fullerene structures are commonly known as carbon "nanotubes" or "buckytubes" and may have single or multi-walled structures. 99.5% pure $C_{60}$ fullerenes are commercially available from, for example, MER Corporation, of Tucson, Ariz.

The thickness of the one or more layers 504 may be about 5 to about 25 times less than a thickness of the one or more layers 502, such as about 10 to about 25 times less than the thickness of the one or more layers 502, about 15 to about 20 times less than the thickness of the one or more layers 502, about 1 to about 10 times less than the thickness of the one or more layers 502, or about 15 to about 20 times less than the thickness of the one or more layers 502. For example, the thickness of the one or more layers 504 may be about 100 μm to about 1000 μm, such as about 100 μm to about 500 μm or about 150 μm to about 300 μm.

The assembly 500 including the substrate 104 and the one or more layers 502, 504 may be placed in a pressure transmitting medium, such as a refractory metal can embedded in pyrophillite or other pressure transmitting medium. The pressure transmitting medium, including the assembly 500 enclosed therein, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table 102' that is shown in FIG. 5B. For example, the pressure of the HPHT process may be about 7 GPa to about 10 GPa and the temperature of the HPHT process may be about 1150° C. to about 1550° C. (e.g., about 1200° C. to about 1400° C.). The foregoing pressure values employed in the HPHT process refer to the pressure in the pressure transmitting medium that transfers the pressure from the ultra-high pressure press to the assembly 300.

Upon cooling from the HPHT process, the PCD table 102' becomes bonded (e.g., metallurgically) to the substrate 104. The PCD table 102' includes the first PCD region 116 formed from the one or more layers 504 and the infiltrated metal-solvent catalyst and the second PCD region 118 formed from the one or more layers 502 and the infiltrated metal-solvent catalyst.

During the HPHT process, metal-solvent catalyst from the substrate 104 may be liquefied and may infiltrate into the diamond particles of the one or more layers 502 of diamond particles. The infiltrated metal-solvent catalyst functions as a catalyst that catalyzes formation of directly bonded-together diamond grains from the diamond particles to form the PCD table 102'. Also, the $sp^2$-carbon-containing material of the one or more $sp^2$-carbon-containing additives in the one or more layers 504 (e.g., graphite, graphene, fullerenes, the shell of the ultra-dispersed diamond particles, or combinations of the foregoing) may be substantially converted to diamond during the HPHT process. The PCD table 102' is comprised of a plurality of directly bonded-together diamond grains, with the infiltrated metal-solvent catalyst disposed interstitially between the bonded diamond grains.

In other embodiments, the metal-solvent catalyst may be mixed with the diamond particles of the one or more layers 502 and/or the diamond particles and the one or more $sp^2$-carbon-containing additives of the one or more layers 504. In other embodiments, the metal-solvent catalyst may be infiltrated from a thin disk of metal-solvent catalyst disposed between the one or more layers 502 and the substrate 104.

Referring to FIG. 5C, the PCD table 102' may be subjected to a planarization process, such as lapping, to planarize an upper surface of the PCD table 102' and form the major surface 112. A grinding process may be used to form the chamfer 114 in the PCD table 102' before or after the planarization process. The planarized and chamfered PCD table 102' is represented in FIGS. 1A and 1B as the PCD table 102. The peripheral surface 110 may be defined by grinding the PCD table 102' using a centerless abrasive grinding process or other suitable process before or after the planarization process and/or forming the chamfer 114.

After forming the major surface 112 and the chamfer 114, the PCD table 102 may be leached in a suitable acid or by another suitable method to form the leached region 124 (FIG. 3), while the un-leached region of the PCD table 102 is represented as the region 126 in FIG. 3. For example, the acid may be aqua regia, nitric acid, hydrofluoric acid, or combinations thereof.

Although the methods described with respect to FIGS. 5A-5C are form integrally forming the PCD table 102 with the substrate 104. In other embodiments, the PCD table may be preformed in a first HPHT process and bonded to a new substrate in a second HPHT process. For example, in an embodiment, the PCD table 102 shown in FIGS. 1A and 1B may be separated from the substrate 104 by removing the substrate 104 via grinding, electro-discharge machining, or another suitable technique. The separated PCD table 102 may be immersed in any of the disclosed leaching acids to substantially remove all of the metal-solvent catalyst used to form the PCD table 102. After leaching, the at least partially leached PCD table (i.e., a pre-sintered PCD table) may be placed adjacent to a new substrate 104, with the region fabricated with the one or more $sp^2$-carbon-containing additives positioned remote from the new substrate 104. The at least partially leached PCD table is bonded to the new substrate 104 in a second HPHT process that may employ HPHT process conditions that are the same or similar to that used to form the PCD table 102.

In the second HPHT process, a cementing constituent from the new substrate 104 (e.g., cobalt from a cobalt-cemented tungsten carbide substrate) infiltrates into the at least partially leached PCD table. Upon cooling, the infiltrant from the new substrate 104 forms a strong metallurgical bonded with the infiltrated PCD table. In some embodiments, the infiltrant may be at least partially removed from the infiltrated PCD table of the new PDC in a manner similar to the way the PCD table 102 is leached in FIG. 3 to enhance thermal stability and/or wear resistance.

In other embodiments, the PCD table 102 may be fabricated to be freestanding (i.e., not on a substrate) in a first HPHT process, at least partially leached, bonded to a new substrate 104 in a second HPHT process, and, if desired, at least partially leached after bonding to the new substrate 104 to at least partially remove an infiltrant from the new substrate 104. For example, the infiltrant may be cobalt from a cobalt-cemented tungsten carbide substrate that infiltrates into the at least partially freestanding PCD table during the second HPHT process.

Figure 6A:
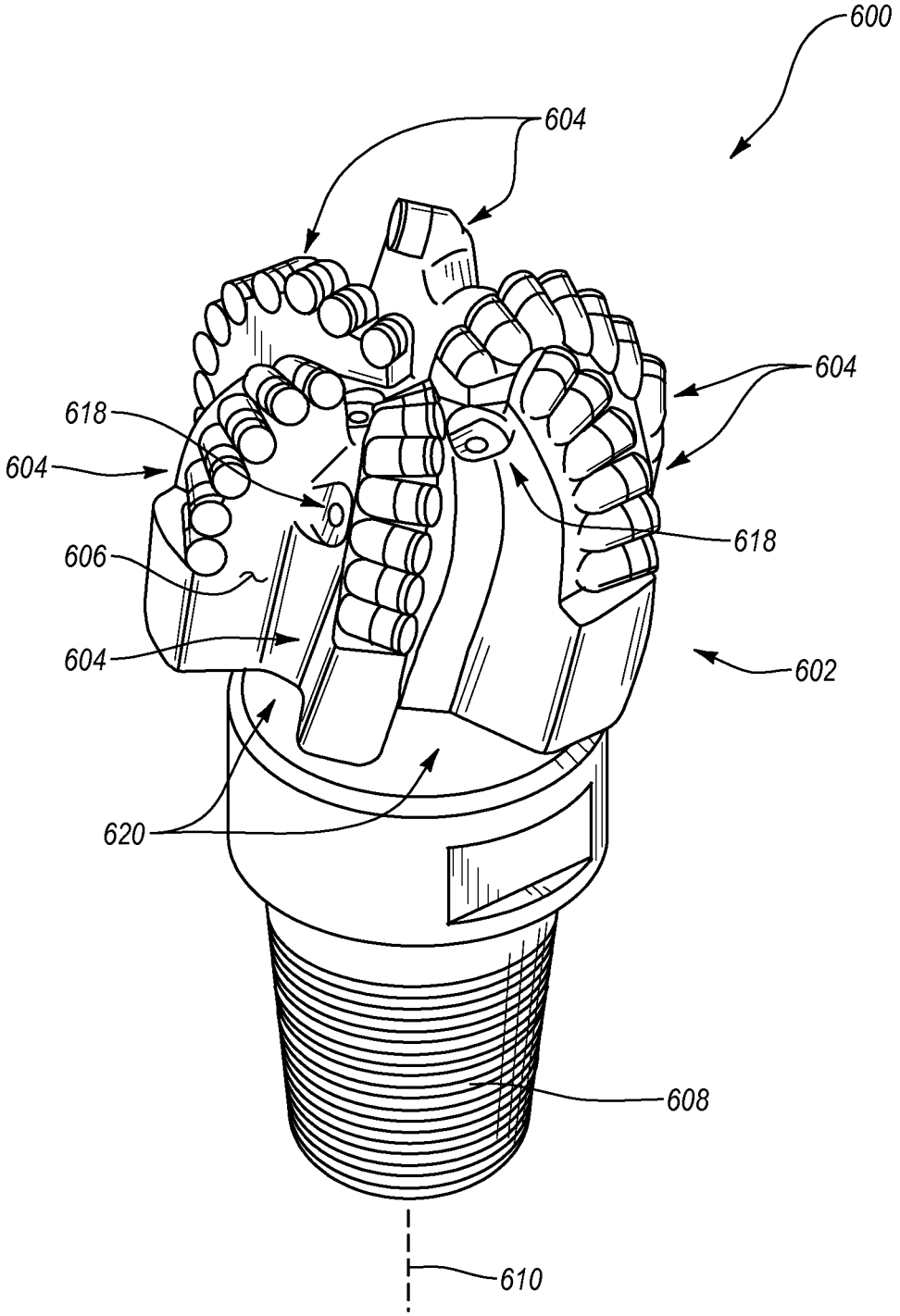
FIG. 6A is an isometric view of an embodiment of a rotary drill bit that may employ one or more of the disclosed PDC embodiments.
Figure 6B:
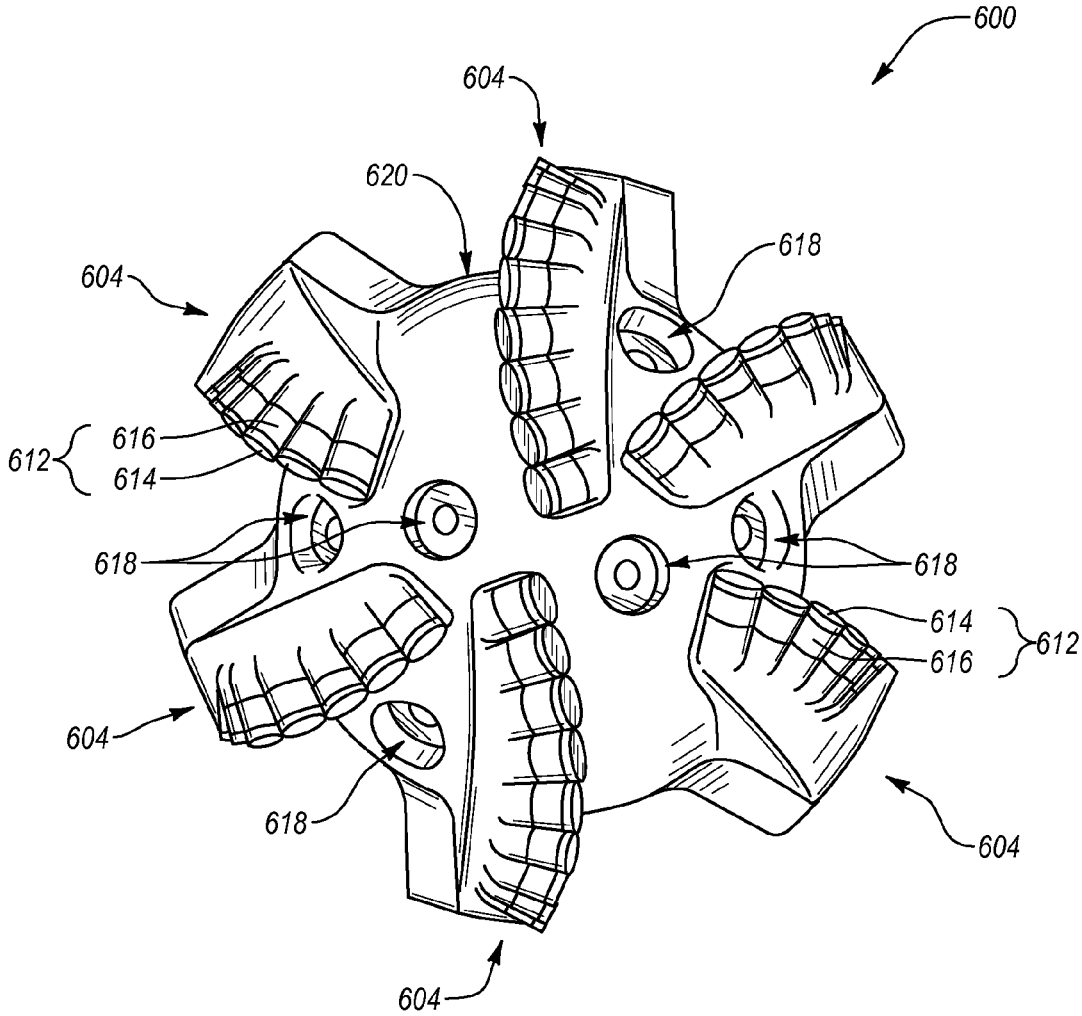
FIG. 6B is a top elevation view of the rotary drill bit shown in FIG. 6A.

FIG. 6A is an isometric view and FIG. 6B is a top elevation view of an embodiment of a rotary drill bit 600 that may employ one or more of the disclosed PDC embodiments. The rotary drill bit 600 comprises a bit body 602 that includes radially- and longitudinally-extending blades 604 having leading faces 606, and a threaded pin connection 608 for connecting the bit body 602 to a drilling string. The bit body 602 defines a leading end structure for drilling into a subterranean formation by rotation about a longitudinal axis 610 and application of weight-on-bit. At least one PDC cutting element, configured according to any of the previously described PDC embodiments, may be affixed to the bit body 602 by brazing, press-fitting, or other suitable technique. For example, each of a plurality of PDC cutting elements 612 is secured to the blades 604 of the bit body 602. Each PDC cutting element 612 may include a PCD table 614 bonded to a substrate 616. If desired, in some embodiments, a number of the PDC cutting elements 612 may be conventional in construction, while a number of the PDC cutting elements 612 may be configured according to any of the previously described PDC embodiments. Also, circumferentially adjacent blades 604 define so-called junk slots 620 therebetween. Additionally, the rotary drill bit 600 includes a plurality of nozzle cavities 618 for communicating drilling fluid from the interior of the rotary drill bit 600 to the cutting element assemblies 612.

FIGS. 6A and 6B merely depict one embodiment of a rotary drill bit that employs at least one PDC fabricated and structured in accordance with the disclosed embodiments, without limitation. The rotary drill bit 600 is used to represent any number of earth-boring tools or drilling tools, including, for example, core bits, roller-cone bits, fixed-cutter bits, eccentric bits, bicenter bits, reamers, reamer wings, or any other downhole tool including PDCs, without limitation.

The PDCs disclosed herein (e.g., the PDC 100 shown in FIG. 1A) may also be utilized in applications other than cutting technology. For example, the disclosed PDC embodiments may be used in wire-drawing dies, bearings, artificial joints, inserts, cutting elements, and heat sinks Thus, any of the PDCs disclosed herein may be employed in an article of manufacture including at least one PCD element PDC.

Thus, the embodiments of PDCs disclosed herein may be used on any apparatus or structure in which at least one conventional PDC is typically used. For example, in one embodiment, a rotor and a stator (i.e., a thrust bearing apparatus) may each include a PDC (e.g., the PDC 100 shown in FIG. 1A) according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller cone type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

The following working examples provide further detail in connection with the specific embodiments described above. Comparative working example 1 is compared to working example 1 fabricated according to a specific embodiment of the invention.

Comparative Working Example 1

One PDC was formed according to the following process. A mass of diamond particles having an average particle size of about 19 μm was mixed with about 5 wt % graphite to form a mixture. The mixture was disposed on a cobalt-cemented tungsten carbide substrate. The mixture and the cobalt-cemented tungsten carbide substrate were HPHT processed in a high-pressure cubic press at a temperature of about 1400° C. and a pressure of about 5 GPa to about 7 GPa to form a PDC comprising a PCD table integrally formed and bonded to the cobalt-cemented tungsten carbide substrate. The PCD table exhibited a thickness of about 0.090 inch and a chamfer exhibiting a length of 0.0120 inch at an angle of about 45° with respect to a top surface of the PCD table was machined therein.

Figure 7:
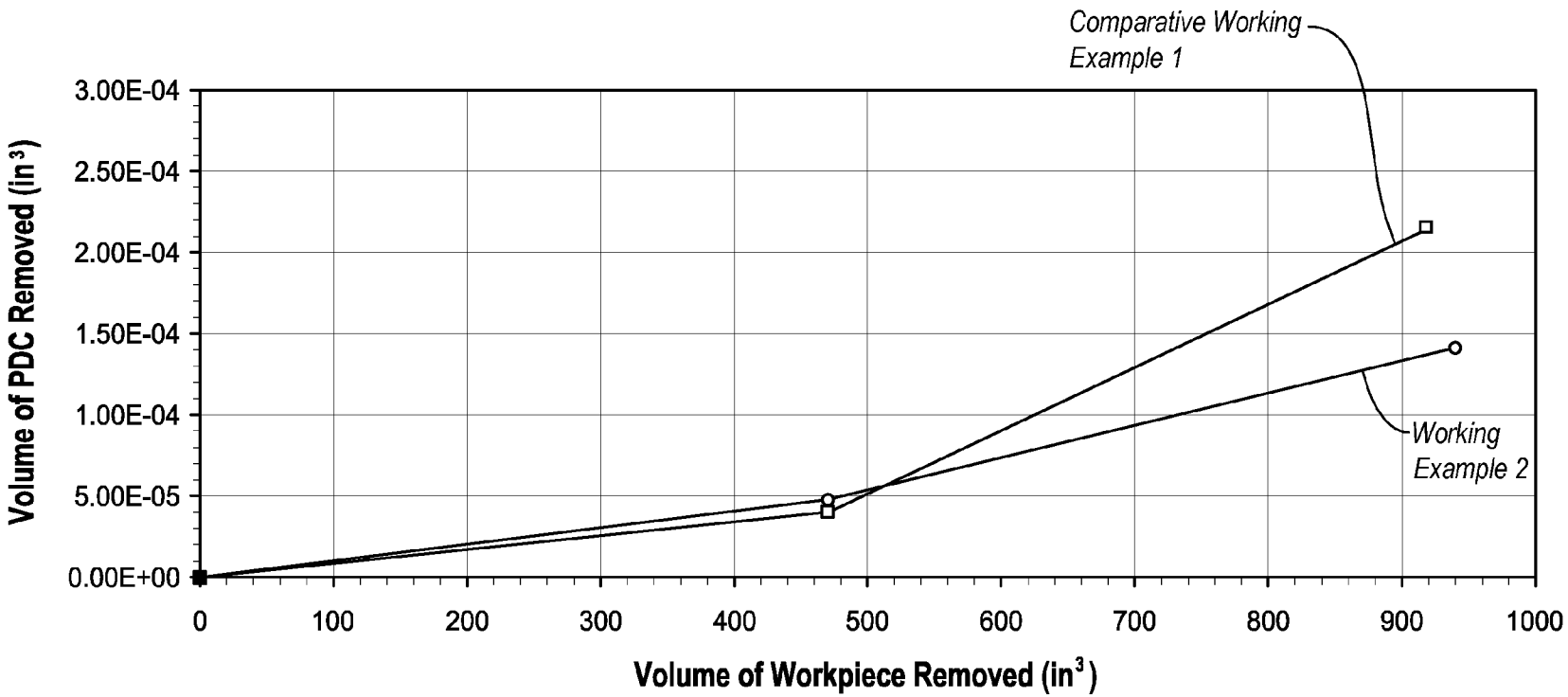
FIG. 7 is a graph of volume of PDC removed versus volume of workpiece removed for comparative working example 1 and working example 2 according to an embodiment of the invention.

The abrasion resistance of the PDC of comparative working example 1 was evaluated by measuring the volume of PDC removed versus the volume of Barre granite workpiece removed, while the workpiece was cooled with water. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM. FIG. 7 shows the abrasion resistance test results for the PDC of comparative working example 1.

Working Example 2

In accordance with an embodiment of the invention, one PDC was formed according to the following process. A mass of diamond particles having an average particle size of about 19 μm was mixed with about 5 wt % graphite to form a first mixture. A mass of diamond particles having an average particle size of about 20 μm was mixed with about 10 wt % tungsten carbide particles to form a second mixture. A layer of the second mixture was disposed between a cobalt-cemented tungsten carbide substrate and a layer of the first mixture. The mixtures and the cobalt-cemented tungsten carbide substrate were HPHT processed in a high-pressure cubic press at a temperature of about 1400° C. and a pressure of about 5 GPa to about 7 GPa to form a PDC comprising a PCD table integrally formed and bonded to the cobalt-cemented tungsten carbide substrate. The PCD table exhibited a thickness of about 0.083 inch and a chamfer exhibiting a length of 0.0120 inch at an angle of about 45° with respect to a top surface of the PCD table was machined therein.

The abrasion resistance of the conventional PDC of working example 2 was evaluated by measuring the volume of PDC removed versus the volume of Bane granite workpiece removed, while the workpiece was cooled with water, using the same workpiece and the same test parameters as comparative working example 1. As shown in FIG. 7, the abrasion resistance of the PDC of working example 2 was greater than that of the PDC of comparative working example 1. The improved abrasion resistance is believed to be due to the formation of a well-defined cutting lip on the PCD table defined by the region of the PCD table that was partially made from the first mixture.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A method of fabricating a polycrystalline diamond compact, comprising:

forming an assembly including:

a first region including a mixture having diamond particles exhibiting a first average particle size and one or more $sp^2$-carbon-containing additives, the first region exhibiting a first thickness;

a substrate; and an intermediate second region disposed between the substrate and the first region, the intermediate second region including diamond particles exhibiting a second average particle size greater than that of the first average particle size of the diamond particle of the first region, the intermediate second region exhibiting a second thickness such that the first thickness is about 5 to about 25 times less than the second thickness, the intermediate region being substantially free of $sp^2$-carbon-containing additives; and subjecting the assembly to a high-pressure/high-temperature process to sinter the diamond particles of the first region and the intermediate second region in the presence of a metal-solvent catalyst so that a polycrystalline diamond table is formed that bonds to the substrate.

2. The method of claim 1 wherein the one or more $sp^2$-carbon-containing additives comprise graphite particles, graphene particles, fullerene particles, ultra-dispersed diamond particles, or combinations thereof.

3. The method of claim 1 wherein the one or more $sp^2$-carbon-containing additives comprise greater than zero to about 15 weight percent of the mixture.

4. The method of claim 1 wherein one or more $sp^2$-carbon-containing additives comprise about 2 weight percent to about 10 weight percent of the mixture.

5. The method of claim 1 wherein one or more $sp^2$-carbon-containing additives comprise about 3 weight percent to about 6 weight percent of the mixture.

6. The method of claim 1 wherein one or more $sp^2$-carbon-containing additives comprise about 5 weight percent of graphite particles.

7. The method of claim 1 wherein the intermediate second region comprises an additive that is selected to lower at least one of thermal stability or wear resistance relative to the first region.

8. The method of claim 7 wherein the additive in the intermediate second region comprises a metal carbide.

9. The method of claim 7 wherein the one or more $sp^2$-carbon-containing additives comprise about 3 weight percent to about 6 weight percent of the mixture of the first region, and wherein the additive in the intermediate second region comprises about 5 weight percent to about 15 weight percent.

10. The method of claim 1, further comprising:

wherein subjecting the assembly to a high-pressure/high-temperature process to sinter the diamond particles of the first region and the intermediate second region so that a polycrystalline diamond table is formed that bonds to the substrate comprises infiltrating the first region and the intermediate region with the metal-solvent catalyst from the substrate to incorporate the metal-solvent catalyst in the polycrystalline diamond table; and at least partially leaching the metal-solvent catalyst from a portion of the polycrystalline diamond table.

11. The method of claim 1 wherein the diamond particles of the first region exhibit a first average diamond particle size and the diamond particles of the second region exhibit a second average diamond particle size different than the first average diamond particle size.

12. A method of fabricating a polycrystalline diamond compact, comprising:

forming an assembly including:

a first region including a mixture having diamond particles exhibiting a first average particle size and one or more sp2-carbon-containing additives;

a substrate; and an intermediate second region disposed between the substrate and the first region, the intermediate second region including diamond particles exhibiting a second average particle size greater than that of the first average particle size of the diamond particle of the first region, the intermediate region being 5 to 25 times thicker than the first region; and subjecting the assembly to a high-pressure/high-temperature process to sinter the diamond particles of the first region and the intermediate second region in the presence of a metal-solvent catalyst so that a polycrystalline diamond table is formed that bonds to the substrate wherein the one or more $sp^2$-carbon-containing additives are present in the first region in an amount effective to promote cutting lip formation in the polycrystalline diamond table during cutting operations.

13. A method of fabricating a polycrystalline diamond compact, comprising:

preparing an assembly by:

adding one or more $sp^2$-carbon-containing additives to a first group of diamond particles exhibiting a first average particle size to form a mixture;

forming a first region at least partially from the mixture;

forming an intermediate second region without adding $sp^2$-carbon-containing additives, the intermediate second region positioned between the first region and a substrate, the intermediate second region formed at least partially from a second group of diamond particles having a second average particle size that is greater than the first average particle size of the diamond particles of the first group of diamond particles; and subjecting the assembly to a high-pressure/high-temperature process to sinter the diamond particles of the first region and the intermediate second region in the presence of a metal-solvent catalyst so that a polycrystalline diamond table is formed that bonds to the substrate.

* * * * *

UNITED STATES PATENT AND TRADEMARK OFFICE

CERTIFICATE OF CORRECTION

PATENT NO. : 8,702,824 B1
APPLICATION NO. : 12/875380
DATED : April 22, 2014
INVENTOR(S) : Sani et al.

It is certified that error appears in the above-identified patent and that said Letters Patent is hereby corrected as shown below:

In the Claims,

In Column 12, Claim 12, Line 47, delete "sp2-carbon-containing" and insert -- $sp^2$-carbon-containing --, therefor.

In Column 12, Claim 12, Line 60, delete "substrate" and insert -- substrate; --, therefor.

Signed and Sealed this
Twenty-third Day of June, 2015

Michelle K. Lee

Michelle K. Lee
*Director of the United States Patent and Trademark Office*